US006814433B2

(12) United States Patent
Putman et al.

(10) Patent No.: US 6,814,433 B2
(45) Date of Patent: Nov. 9, 2004

(54) BASE APERTURE IN INK JET CARTRIDGE WITH IRREGULAR EDGES FOR BREAKING SURFACE TENSION OF THE INK

(75) Inventors: William A. Putman, Franklin, TN (US); Stephen A. Anderson, Thompson Station, TN (US)

(73) Assignee: Nu-Kote International, Inc., Dallas, TX (US)

( * ) Notice: Subject to any disclaimer, the term of this patent is extended or adjusted under 35 U.S.C. 154(b) by 0 days.

(21) Appl. No.: 10/170,479

(22) Filed: Jun. 13, 2002

(65) Prior Publication Data

US 2003/0007044 A1 Jan. 9, 2003

Related U.S. Application Data

(60) Provisional application No. 60/298,041, filed on Jun. 13, 2001.

(51) Int. Cl.[7] ..... B41J 2/175
(52) U.S. Cl. ..... 347/86
(58) Field of Search ..... 347/84–87

(56) References Cited

U.S. PATENT DOCUMENTS

| | | | |
|---|---|---|---|
| 3,940,807 | A | 3/1976 | Baker et al. |
| 3,967,286 | A | 6/1976 | Andersson et al. |
| 4,005,440 | A | 1/1977 | Amberntsson et al. |
| 4,015,271 | A | 3/1977 | Sultan |
| 4,095,237 | A | 6/1978 | Amberntsson et al. |
| 4,279,519 | A | 7/1981 | Shiurila |
| 4,336,767 | A | 6/1982 | Wada |
| 4,400,102 | A | 8/1983 | Shiurila et al. |
| 4,403,874 | A | 9/1983 | Payne et al. |
| 4,579,468 | A | 4/1986 | Gomi et al. |
| 4,771,298 | A | 9/1988 | Lee et al. |
| 5,025,271 | A | 6/1991 | Baker et al. |
| 5,084,713 | A | 1/1992 | Wong |
| 5,156,471 | A | 10/1992 | Suzuki et al. |
| 5,174,665 | A | 12/1992 | Suzuki et al. |
| D351,190 | S | 10/1994 | Oshima et al. |
| 5,363,130 | A | 11/1994 | Cowger et al. |
| 5,444,474 | A | 8/1995 | Ohtsubo et al. |
| 5,477,963 | A | 12/1995 | Mochizuki et al. |
| D369,383 | S | 4/1996 | Miyazawa et al. |
| 5,560,720 | A | 10/1996 | Suzuki et al. |
| 5,576,749 | A | 11/1996 | Mochizuki et al. |
| 5,590,510 | A | 1/1997 | Mochizuki et al. |
| 5,603,577 | A | 2/1997 | Suzuki et al. |
| 5,607,242 | A | 3/1997 | Suzuki et al. |
| 5,615,957 | A | 4/1997 | Suzuki et al. |
| 5,622,439 | A | 4/1997 | Suzuki et al. |

(List continued on next page.)

FOREIGN PATENT DOCUMENTS

| | | |
|---|---|---|
| EP | 0 529 879 A1 | 8/1992 |
| EP | 0 635 373 A1 | 12/1993 |
| EP | 0 624 475 B1 | 5/1994 |
| EP | 0 624 475 A3 | 5/1994 |
| EP | 0 624 475 A2 | 5/1994 |
| EP | 0 633 138 A3 | 7/1994 |
| EP | 0 633 138 A2 | 7/1994 |
| EP | 0 647 527 A1 | 10/1994 |

OTHER PUBLICATIONS

Patent Abstracts of Japan—Pub. No. 59143646—Pub. Date Aug. 17, 1984.

*Primary Examiner*—An H. Do
(74) *Attorney, Agent, or Firm*—Fay, Sharpe, Fagan, Minnich & McKee, LLP

(57) ABSTRACT

An aperture provided in a bottom wall of an ink cartridge is designed to break the surface tension of the ink as the ink proceeds toward an outlet port. For example, serrated edges, tapering conformations, cruciform dividing walls, different diameter regions in the outlet passage, etc. are all designed to prevent the formation of large bubbles or preclude the migration of air bubbles to the region of the outlet passage where the print needle of an associated printer extends.

19 Claims, 8 Drawing Sheets

U.S. PATENT DOCUMENTS

| | | | |
|---|---|---|---|
| D381,039 | S | 7/1997 | Shinada et al. |
| D389,180 | S | 1/1998 | Miyazawa et al. |
| D390,598 | S | 2/1998 | Miyazawa et al. |
| 5,790,158 | A | 8/1998 | Shinada et al. |
| 5,821,965 | A | 10/1998 | Oda et al. |
| 5,875,615 | A | 3/1999 | Ito et al. |
| 5,950,403 | A | 9/1999 | Yamaguchi et al. |
| 6,045,207 | A | 4/2000 | Mochizuki et al. |
| 6,048,056 | A | 4/2000 | Hotomi |
| 6,058,984 | A | 5/2000 | Sato |
| D427,236 | S | 6/2000 | Shinada et al. |
| 6,086,193 | A | 7/2000 | Shimada et al. |
| 6,123,469 | A | 9/2000 | Suzuki et al. |
| 6,145,974 | A | 11/2000 | Shinada et al. |
| 6,170,941 | B1 | 1/2001 | Hara et al. |
| 6,238,042 | B1 | 5/2001 | Kobayashi et al. |
| 6,325,499 | B1 | 12/2001 | Betschon |

BASE APERTURE IN INK JET CARTRIDGE WITH IRREGULAR EDGES FOR BREAKING SURFACE TENSION OF THE INK

CROSS-REFERENCE TO RELATED APPLICATION

This application claims priority from provisional application Ser. No. 60/298,041, filed Jun. 13, 2001.

BACKGROUND OF THE INVENTION

This application relates to an ink jet cartridge or cassette as used in an ink jet printer, and more particularly to an apparatus for reducing the introduction of air into the system. It will be appreciated, however, that the invention may find application in related environments and applications that encounter these same issues.

It is generally known in the art to form a cartridge housing or body having one or more cavities or chambers that hold a predetermined supply of ink. For example, a single color of ink may be provided in a single chamber cartridge. Alternately, multiple chambers may be provided, for example, each holding a different color ink stored therein for selective use in a color printer. It is also generally known to provide an ink absorbing member such as a reticulated polyurethane, melamine, or polyethylene foam (a hydrophilic foam) that fits within the chamber. In some arrangements, the ink absorbing member fills the substantial entirety of the chamber, while in other instances a portion of the ink supply is free ink and the remainder is stored in the ink absorbing member. In still other arrangements, the cartridge contains only free ink. One or more outlet ports communicate with the respective one or more chambers through outlet passages. The outlet passage proceeds through a first or bottom wall of the housing. A supply needle from an associated printer extends through the outlet port and thus conveys ink from the housing to a recording head or printhead.

Print quality can be adversely effected by the introduction of air into the ink cartridge, for example, into the chamber or outlet passage. Thus, manufacturers of ink cartridges are careful in the design and assembly, i.e., filling, to limit the potential for air introduction into the system. One area of potential air introduction is an aperture of the outlet passage where the outlet passage communicates with the ink chamber. It has been determined that by breaking the surface tension of the ink, air bubbles will be prevented from migrating and thus undesirably forming larger air bubbles in the outlet passage. This is particularly a problem in the outlet passage below the base wall aperture and around the printer needle. Introduction of air interrupts the capillary flow from the chamber to the printhead. Since air can result in print quality problems such as voids or ink starvation, a need exists to improve print quality and particularly limit the potential for air migrating into the outlet passage as it proceeds from the ink chamber to the outlet port.

SUMMARY OF THE INVENTION

The present invention provides an ink cartridge having a housing with a chamber therein for storing ink. A first surface of the housing has an aperture that communicates between the chamber and an outlet passage. The aperture/outlet passage includes means for breaking surface tension of ink as the ink passes therethrough.

In an exemplary embodiment, the surface tension breaking means includes a serrated edge about a periphery of the aperture.

In another embodiment, the means for breaking surface tension includes a substantially cruciform divider disposed in the aperture.

In yet another embodiment, irregular shaped passages lead to the aperture.

The aperture may have a substantially constant cross-section throughout its length or a non-uniform cross-section. A tapering region decreasing in cross-sectional area as it proceeds from the cavity toward the outlet port also provides an alternate embodiment.

A primary advantage of the invention resides in the improved print quality that results.

Another advantage of the invention relates to preventing migration of air bubbles toward the print needle.

Still other advantages and benefits of the invention will become apparent to those skilled in the art upon reading and understanding the following detailed description. de

BRIEF DESCRIPTION OF THE DRAWINGS

The invention may take form in certain components and structures, preferred embodiments of which will be illustrated in the accompanying drawings.

DETAILED DESCRIPTION OF THE INVENTION

Figure 2:
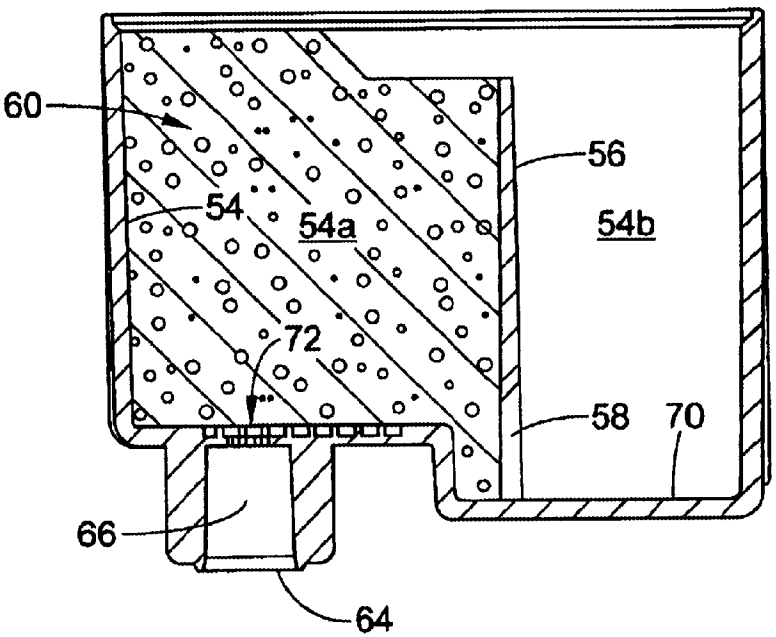
FIG. 2 is a cross-sectional view of an assembled cartridge.
Figure 1:
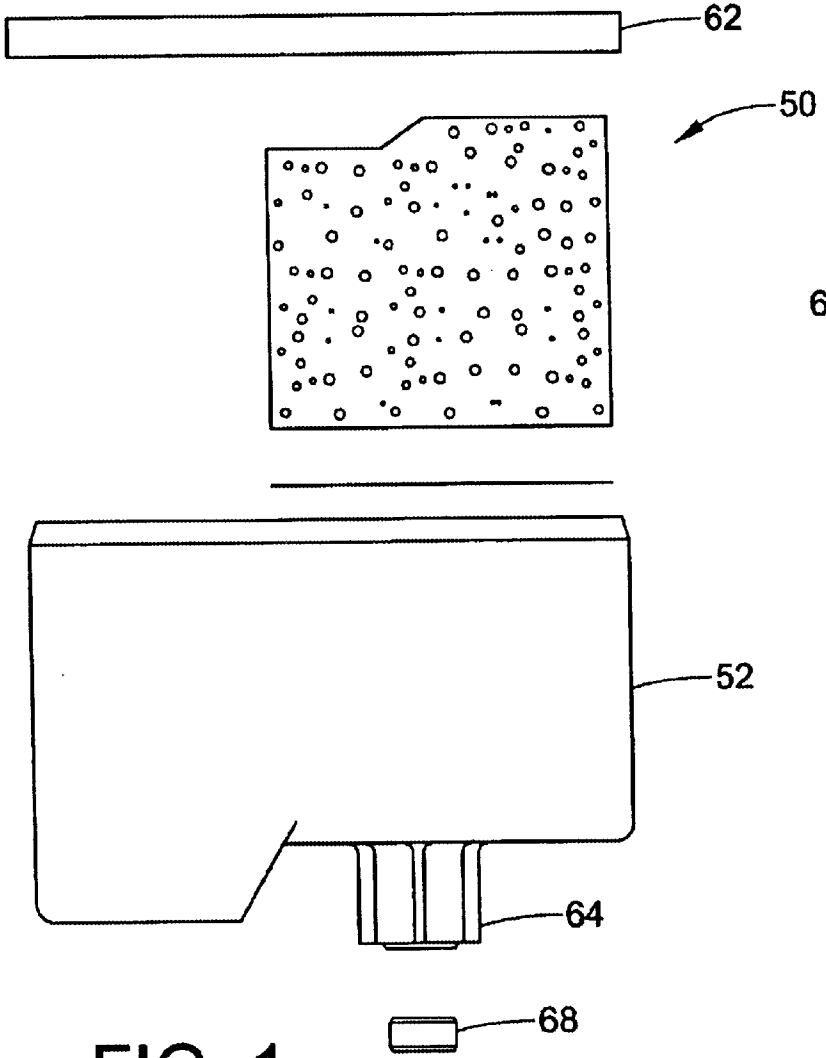
FIG. 1 is an exploded view of an ink jet cartridge.

As illustrated in FIGS. 1 and 2, an ink jet cassette or cartridge 50 includes a housing 52 having an internal chamber or cavity 54 (FIG. 2). As shown here, the housing interior is divided into two chambers 54*a*, 54*b* by a dividing wall 56. It will be appreciated, however, that the housing may have one chamber, or multiple chambers. For example, the cartridge may be partially free ink/partially foam design, or the cartridge may be a single color versus multi-color cartridge. The invention should not however be limited to a single or multi-chamber arrangement. In the partial free ink/partial foam design, a passageway 58 is provided in a base portion of the dividing wall 56 to allow ink to migrate from the free ink side to an ink absorbing member 60. The ink absorbing member is typically a block of porous material or foam such as a reticulated polymer foam or melamine foam, or other conventional ink absorbing member used to store ink within the pores thereof. As shown in FIG. 2, with the partial free ink/partial foam design, the ink absorbing member 60 substantially fills the entire chamber 54*a* on the foam side of the cartridge. In other designs that do not employ free ink, the ink absorbing member will fill substantially the entire cavity or portions of a chamber. Again, the invention should not be so limited to any one of these designs.

A lid or cover 62 (FIG. 1) is received over a first or upper end of the housing and typically sealingly secured in place. For example, the cover may be ultrasonically welded along a peripheral portion to the cartridge housing to seal the components together. An ink outlet port 64 communicates via an outlet passage 66 with the chamber of the cartridge. In this manner, ink flows from the ink chamber through the outlet passage and ultimately reaches the outlet port 64. The outlet port receives an elastomeric grommet member 68 that is selectively pierced by a needle from an associated printer (not shown) to establish communication through the outlet port with the outlet passage 66 in a manner generally well known in the art.

Figure 3:
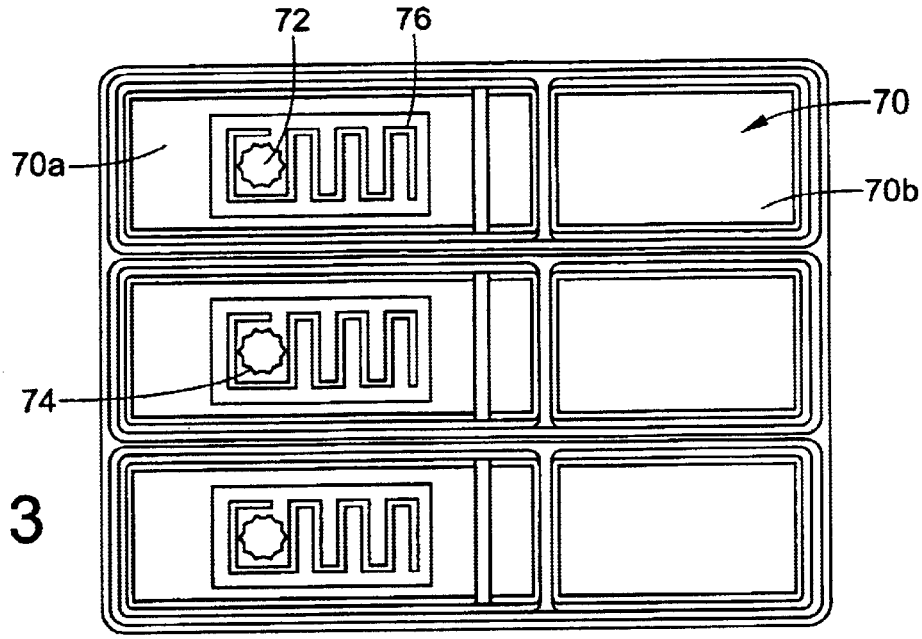
FIG. 3 is a plan view illustrating a first or bottom wall of the cartridge.
Figure 4:
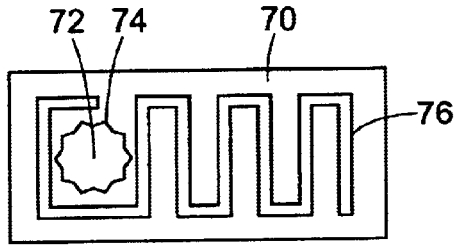
FIG. 4 is an enlarged view of the bottom wall of the cartridge.
Figure 5:
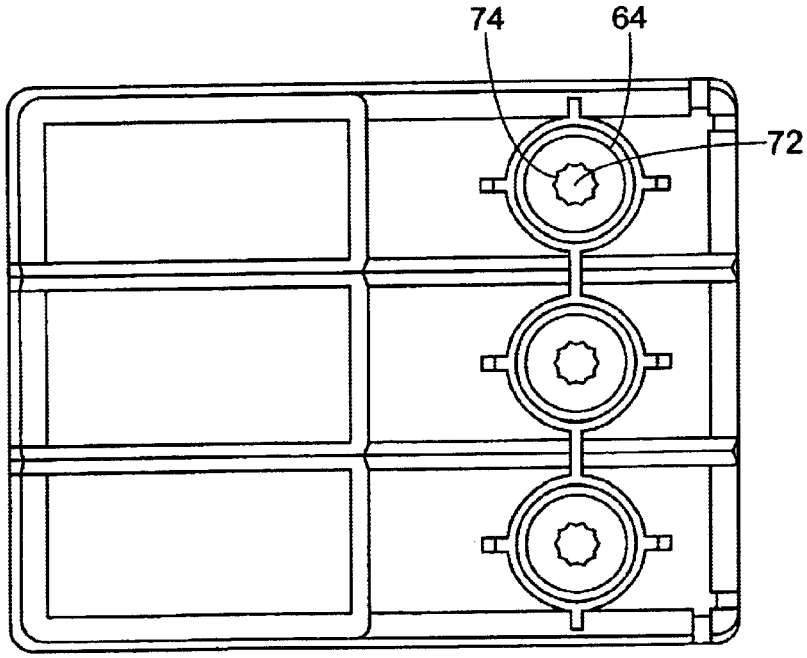
FIG. 5 is a bottom plan view of the cartridge.

As more particularly illustrated in FIG. 2, and in plan view in FIG. 3, a first or bottom wall 70 has a generally stepped configuration. The portion 70*a* is primarily disposed beneath the ink absorbing member 60 and includes an aperture 72 that extends through the bottom wall in fluid communication with the passage 66 and outlet port 64. As perhaps best illustrated in FIG. 3 and the enlarged view of FIG. 4, the aperture 72 has a serrated edge 74. This breaks the surface tension of the ink as it passes from the ink chamber toward the outlet port. In addition, a groove 76 may be provided in the first wall to direct ink toward the aperture. Here, the groove 76 has a serpentine configuration so that it maximizes the collection area over which ink from the ink absorbing member is received in the groove and directed toward the aperture. Thus, the means for breaking the surface tension of the ink is defined, at least in part, by the serrated edge 74 in the embodiment of FIG. 1–5.

Figure 6:
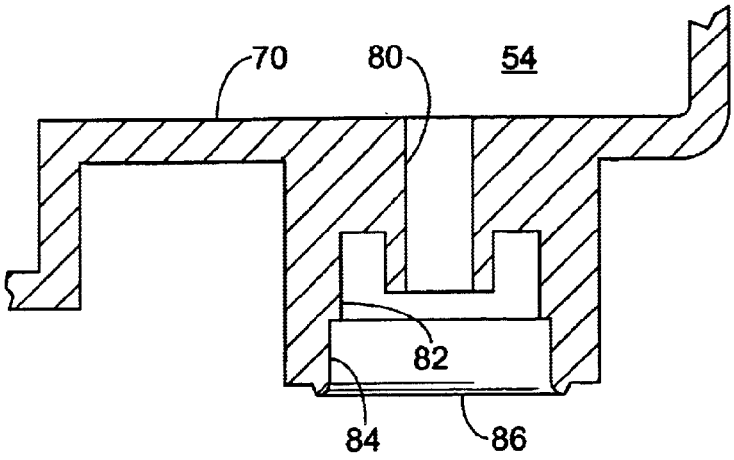
FIG. 6 through 30 are views of alternate embodiments.

In FIG. 6, the means for breaking the surface tension of the ink is slightly different. Here an aperture 80 has a constant dimension and communicates with a stepped outlet passage 82, 84 before reaching the outlet port 86. Again, the variable dimension portions aid in preventing the formation of large air bubbles and the migration of smaller air bubbles toward a printer needle as the ink flows from the chamber 54 through the aperture 80 in the bottom wall 70 to the outlet passage 82, 84 before reaching the outlet port 86.

Figure 7:
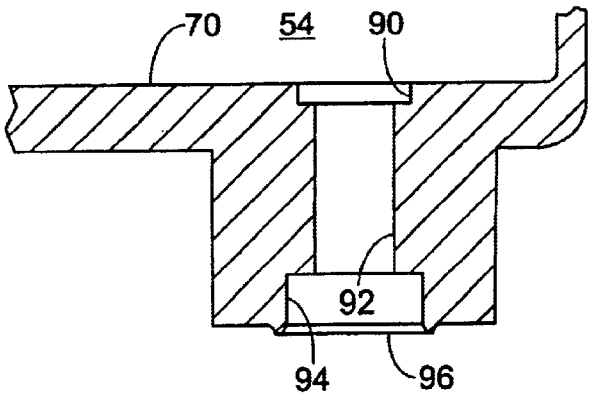
Figure 8:
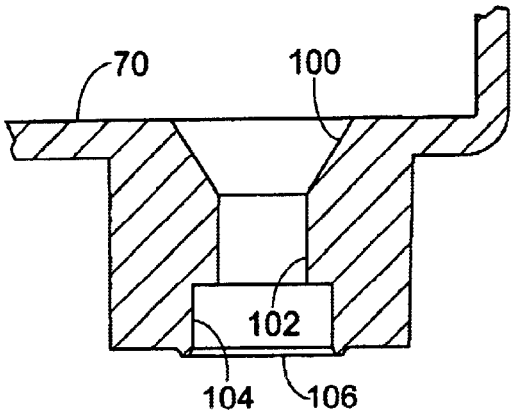
Figure 9:
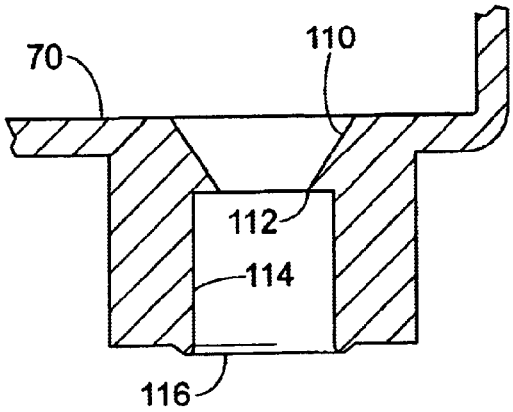

FIG. 7 illustrates a variation on the concept of the variable diameter portions. Here, aperture 90 through the bottom wall 70 has a slightly larger diameter than a first portion 92 of the outlet passage, but is slightly smaller than a second portion 94 of the outlet passage that communicates with the ink outlet port 96. In FIG. 8, the aperture has a tapering conformation that is largest at the bottom wall 70 and reduces toward a small diameter portion 102 of the outlet passage which opens into an enlarged portion 104 that extends to the outlet port 106. Thus, as illustrated in FIG. 8, the cross-sectional dimension of the smaller diameter portion of the taper is substantially the same as the diameter of the smaller portion 102 of the outlet passage. In FIG. 9, however, the taper conformation 110 of the aperture has a minimum diameter represented by reference numeral 112 that is greater than the constant diameter portion of the outlet passage 114. Thus, as the ink travels from the ink chamber toward outlet port 116, it migrates through varying diameters that break the surface tension of the ink, i.e., at the interface 112 between the tapered aperture 110 and the outlet passage 114.

Figure 10:
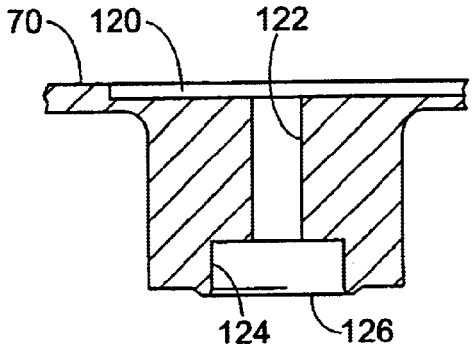

A rectangular recess 120 is provided in the bottom wall 70 of the embodiment of FIG. 10. The recess has a depth dimensioned to receive a filter or screen that is often interposed between the ink chamber and the outlet passage. Alternatively, the recess may be provided simply to facilitate collection of ink from the ink absorbing member. The aperture 122 is illustrated as a constant diameter, leading from the recess that merges into the outlet passage 124 and outlet port 126. The variation in the diameters along the aperture, outlet passage, and outlet port path prevents air bubbles from migrating or forming into enlarged air bubbles around a printer needle.

Figure 11:
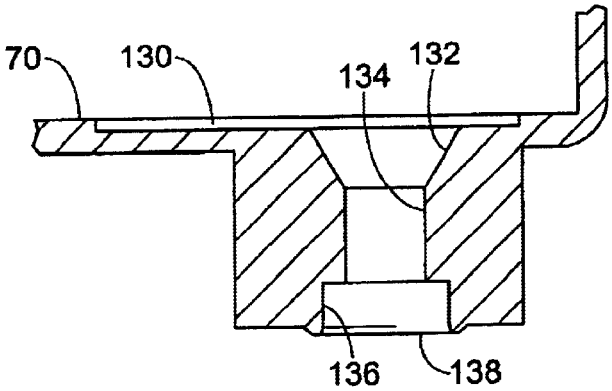

The embodiment of FIG. 11 is substantially similar to that of FIG. 8, and further includes a recess 130. An aperture 132 has a tapering conformation that reduces in cross-section as it merges into a first portion 134 of a stepped configuration outlet passage. A second portion 136 has a slightly larger diameter that is closely dimensioned with the outlet port 138.

Figure 12:
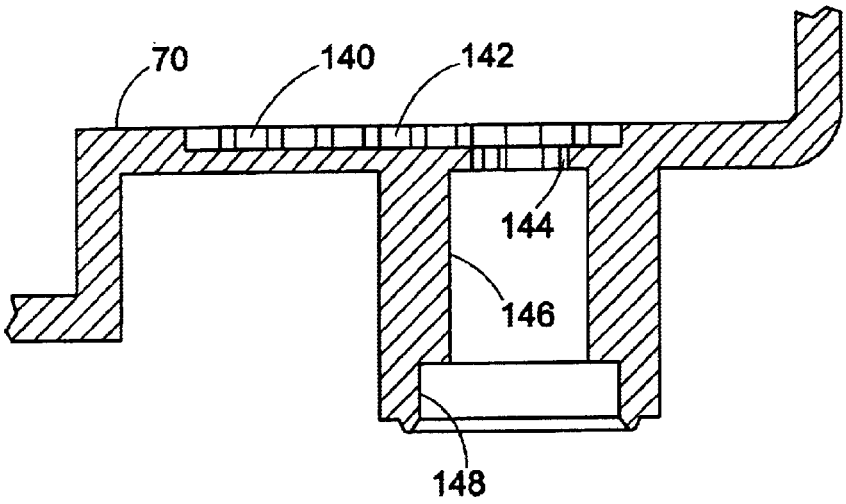

FIG. 12 is a combination of the embodiments of FIGS. 2 and 10. More particularly, a recess 140 provided in the bottom wall 70 of the ink chamber includes a serpentine pathway 42 that communicates with an aperture 144 having a serrated edge. The ink then proceeds into a larger diameter first portion 146 of the outlet passage which merges with an even larger diameter portion 148 or second portion of the outlet passage before reaching the outlet port.

Figure 13:
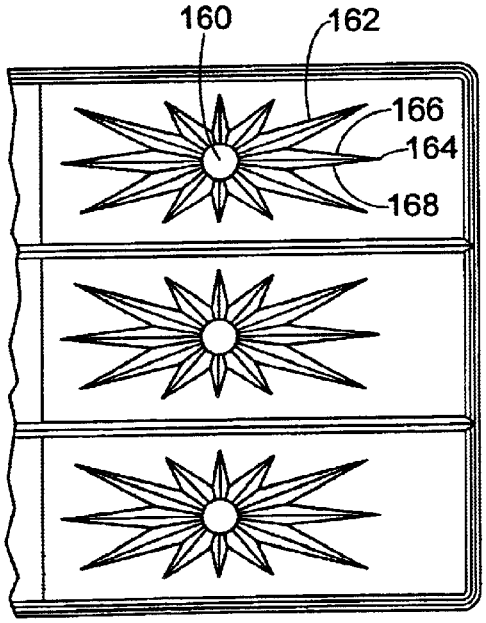
Figure 14:
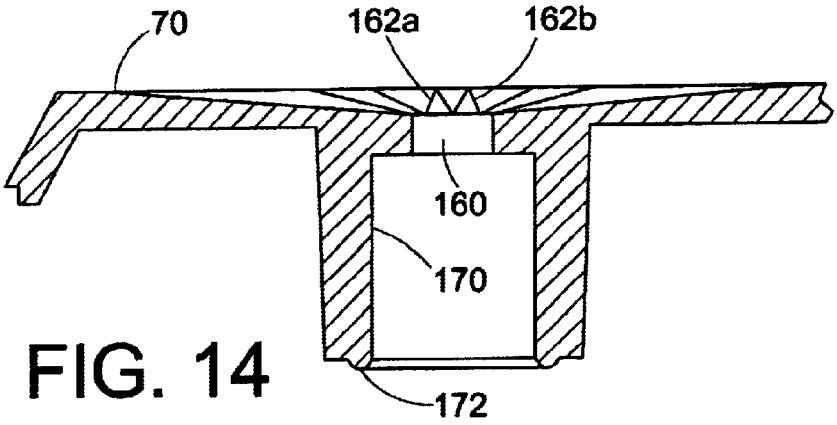
Figure 15:
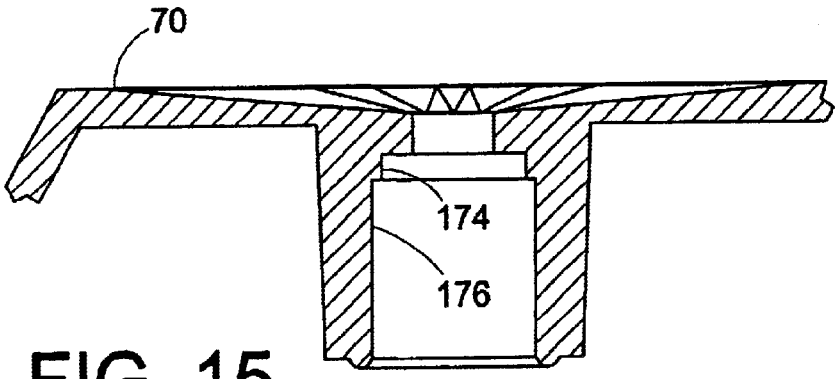

In FIGS. 13 and 14, multiple tapered channels extend generally radially outward from aperture 160. Particularly, each channel portion 162 is comprised of sidewalls 162*a*, 162*b* that angle toward one another from the bottom surface 70 of the ink chamber toward the aperture. It will also be appreciated, that outer peripheral portions of the multi-lobed arrangement merge toward outer terminal points 164 and diverge outwardly along the edges 166, 168 as it extends toward the generally centralized aperture. The aperture, in turn, communicates with an outlet passage 170 before merging into or terminating into outlet port 172. As particularly evident in FIG. 13, twelve channels proceed radially outward from the aperture in the bottom wall. Six of the channels have a shorter radial extent, while the remaining six are substantially longer because of the rectangular conformation of the ink chamber. FIG. 15 illustrates a substantially identical arrangement where the outlet passage comprises two multi-diameter portions 174, 176.

Figure 16:
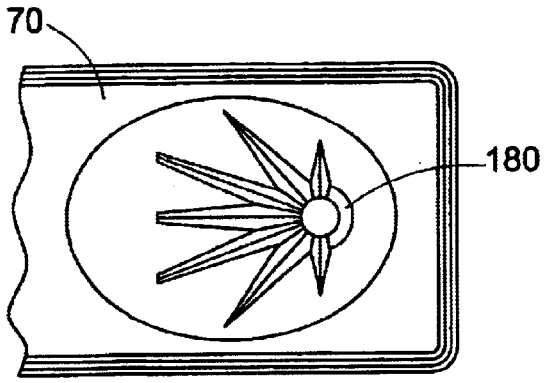
Figure 17:
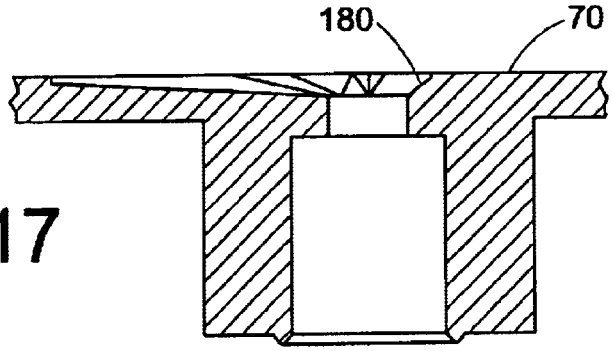

By locating an aperture in the bottom wall 70 closer to one end of the ink chamber than another, the number of radially extending channels or lobes are reduced. Here, FIGS. 16 and 17 illustrate seven such channels, two of them substantially shorter than the other five, due to the rectangular conformation of the ink chamber. An opposite portion at 180 has a tapered conformation since there is insufficient dimension for radially extending channels.

Figure 18:
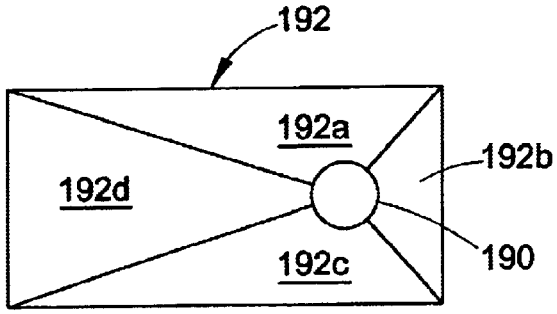
Figure 19:
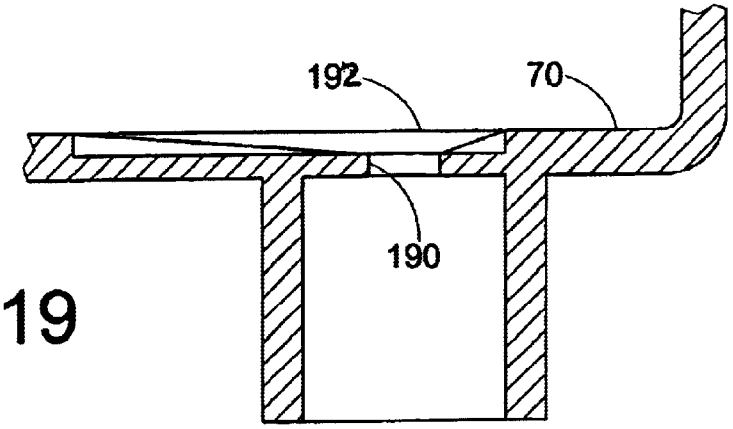
Figure 20:
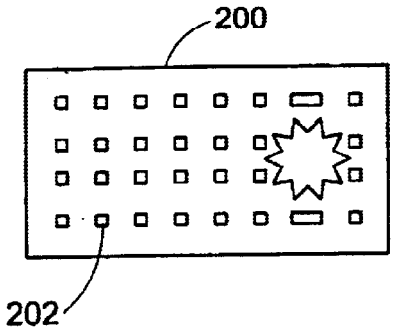

FIGS. 18 and 19 illustrate an aperture 190 disposed more closely adjacent one end of the ink chamber than the other. In order to maximize collection and directing of the ink toward the aperture, recess 192 formed in the bottom wall 70 of the ink chamber has discrete, planar taper regions 192*a*, 192*b*, 192*c*, 192*d* (FIG. 18). The embodiment of FIG. 20 illustrates the recess and may include multiple projections illustrated here as square pegs disposed in aligned rows and columns extending upwardly from the recess toward the height of the bottom wall 70. Again, as ink is collected in the recess 200, the projections 202 prevent air bubbles form forming into larger air bubbles as the ink migrates toward aperture 204 that has a serrated edge.

Figure 21:
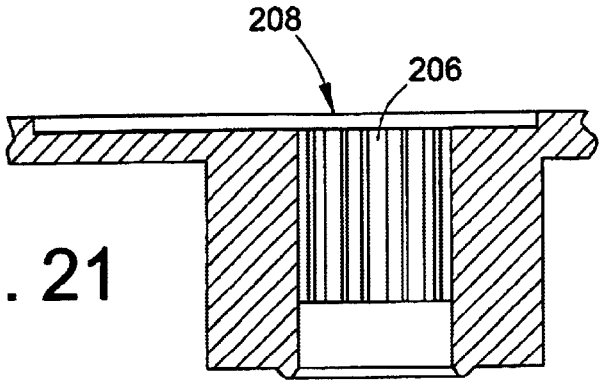
Figure 22:
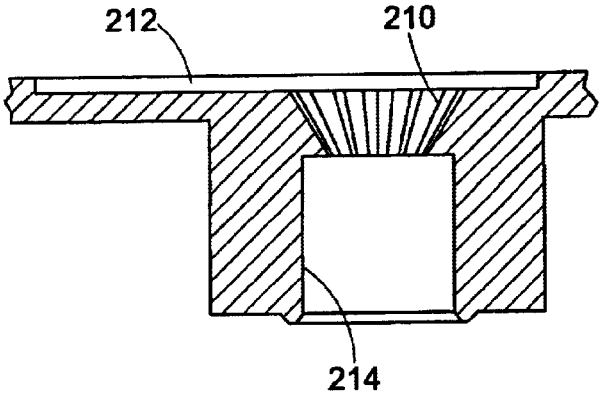

FIG. 21 illustrates that the serrated edges 206 of the aperture 208 may extend for a substantial length over the path toward the outlet port. Otherwise, the embodiment of FIG. 21 is not substantially different from FIG. 2, although the outlet passage has substantially the same diameter as the maximum diameter of the serrated edge aperture. FIG. 22 illustrates that the serrated edge aperture 210 may be combined with the tapered conformation and proceeds from the recess 212 to the outlet passage 214.

Figure 23:
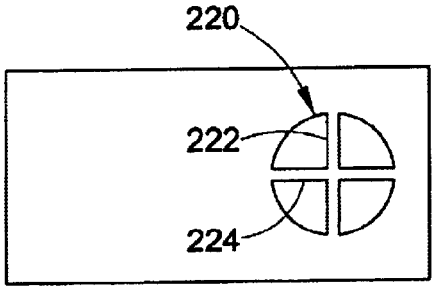
Figure 24:
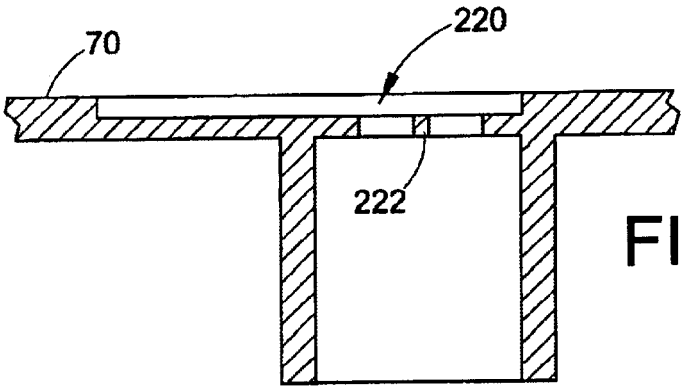
Figure 25:
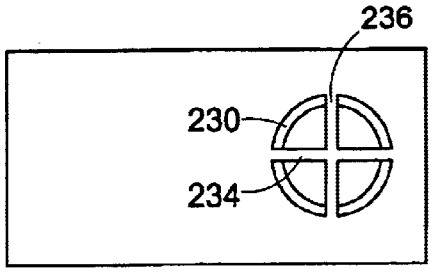
Figure 26:
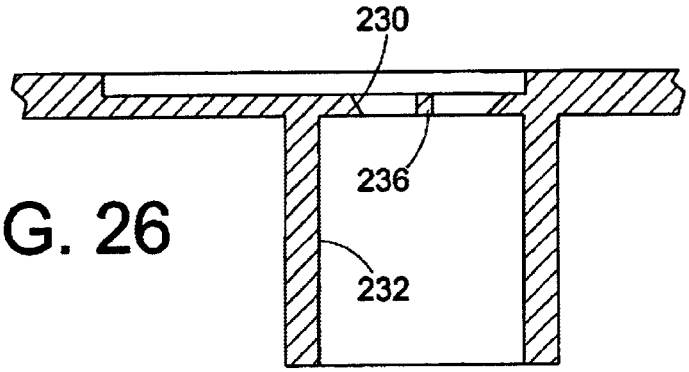
Figure 27:
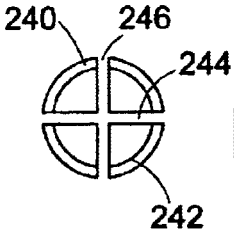
Figure 28:
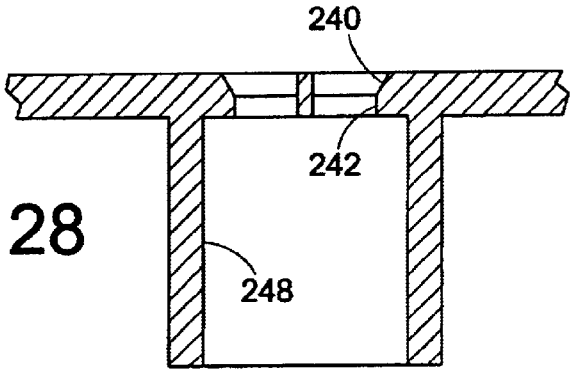
Figure 29:
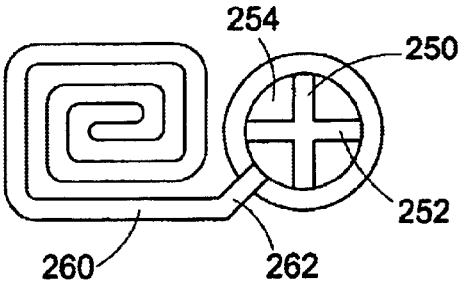
Figure 30:
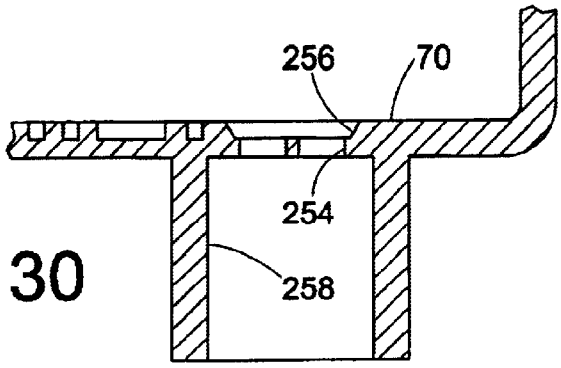

The embodiment of FIGS. 23 and 24 illustrates a slightly different concept for the means for breaking surface tension of the ink as the ink passes through the aperture. Specifically, a cruciform shaped aperture 220 is defined by intersecting diametrically extending dividers 222, 224. This divides the aperture into four pie-shaped quadrants having an irregular periphery that promotes breaking the surface tension of the ink. FIGS. 25 and 26 are similar and illustrate that the aperture has a tapering conformation 230 before the aperture communicates with outlet passage 232. Thus, the cruciform dividing walls 234, 236 proceed across only the aperture portion between the recess and the outlet passage. In FIG. 27, the taper portion 240 merges into a constant diameter portion 242 and the cruciform dividing walls 244, 246 extend over both the tapered portion 240 and constant diameter portion 242 of the aperture, but terminate before the outlet passage 248. FIGS. 29 and 30, on the other hand, illustrate the cruciform dividing walls 250, 252 located only in a constant diameter portion 254 of the aperture and not extending upwardly into the tapered portion 256 that merges into the bottom wall 70 of the ink cartridge. Thus, the cruciform dividing walls interrupt the surface tension of the ink as the ink proceeds from the ink cartridge, through the aperture, and into outlet passage 258. A slightly different conformation for the collection groove 260 is also provided with a portion 262 that merges into the tapering portion 256 of the aperture. This assures a continuous path for capillary flow of ink from the cartridge to the outlet passage.

The application has been described with reference to the preferred embodiments. Obviously, alterations and modifications will occur to others upon a reading and understanding of the specification. For example, the apertures, outlet passages, protrusions, etc., should not be dimensionally constrained and various combinations thereof will still achieve the same purpose of breaking the surface tension of the ink. This invention is intended to include all such modifications and alterations insofar as the come within the scope of the appended claims or the equivalents thereof.

Having thus described the invention, We claim:

1. An ink cartridge comprising:

a housing having
- a cavity for storing ink,
- a first surface,
- an aperture in the first surface an outlet port communicating with the cavity via the aperture and adapted to receive an associated printer needle, the aperture having means for breaking surface tension of ink as it passes therethrough, the means for breaking surface tension includes a serrated edge about the periphery of the aperture, a recess in the first surface surrounding the aperture, the recess includes spaced apart multiple projections throughout a majority of the recess extending upwardly from the recess.

2. The ink cartridge of claim 1 wherein the aperture includes a non-uniform cross-section throughout its length as it proceeds from the cavity to the outlet port.

3. The ink cartridge of claim 2 wherein the non-uniform aperture includes a tapering region that decreases in cross-sectional area as it proceeds from the cavity toward the outlet port.

4. The ink cartridge of claim 1 wherein the means for breaking surface tension includes the aperture having a diameter communicating with the stepped outlet passage, the stepped outlet passage includes a first portion having a diameter and a second portion having a diameter, the aperture diameter is greater than a first portion diameter of the outlet passage.

5. The ink cartridge of claim 4 wherein the aperture diameter is less than the second portion diameter of the outlet passage.

6. The ink cartridge of claim 4 wherein the aperture diameter tapers from the first surface toward the first portion of the outlet passage, the first portion communicates in a stepped fashion with the second portion of the outlet passage, and the first portion diameter is less than the second portion diameter.

7. The ink cartridge of claim 6 wherein the cross-sectional dimension of the smaller diameter of the taper is substantially the same as the diameter of the first portion diameter of the outlet passage.

8. The ink cartridge of claim 6 wherein the first surface further includes a recess dimensioned to receive a filter interposed between the cavity and the outlet passage.

9. An ink cartridge comprising:

a housing having
- a cavity for storing ink,
- a first surface,
- an aperture in the first surface an outlet port communicating with the cavity via the aperture and adapted to receive an associated printer needle, the aperture having means for breaking surface tension of ink as it passes therethrough, the means for breaking surface tension includes a serrated edge about the periphery of the aperture, a recess in the first surface surrounding the aperture, a continuous rectilinear serpentine ridge in the recess, the ridge spaced apart from the aperture.

10. An ink cartridge comprising:

a housing having
- a cavity for storing ink,
- a first surface,
- an aperture in the first surface an outlet port communicating with the cavity via the aperture and a stepped outlet passage adapted to receive an associated printer needle, the aperture having means for breaking surface tension of ink as it passes therethrough, the means for breaking surface tension includes a substantially cruciform divider disposed in the aperture.

11. The ink cartridge of claim 10 wherein the aperture has a substantially constant cross-section through its length between the cavity and the outlet port.

12. The ink cartridge of claim 10 further comprising a recess in the first surface surrounding the aperture.

13. The ink cartridge of claim 12 wherein the recess receives a screen therein for filtering the ink as it proceeds from the cavity to the outlet port.

14. The ink cartridge of claim 13 wherein the aperture includes a non-uniform cross-section throughout its length as it proceeds from the cavity to the outlet port.

15. The ink cartridge of claim 14 wherein the non-uniform aperture includes a tapering region that decreases in cross-sectional area as it proceeds from the cavity toward the outlet port.

16. The ink cartridge of claim 10 wherein the aperture includes a non-uniform cross-section throughout its length as it proceeds from the cavity to the outlet port.

17. The ink cartridge of claim 10 further comprising a continuous rectilinear serpentine groove in the first surface that leads to and is spaced from the aperture.

18. The ink cartridge of claim 17, wherein the means for breaking surface tension includes a series of apertures of varying diameters disposed between the cavity and the outlet port.

19. The ink cartridge of claim 18 wherein the series of apertures increase in diameter proceeding away from the cavity.

* * * * *